US012584197B2

(12) United States Patent
Li et al.

(10) Patent No.: US 12,584,197 B2
(45) Date of Patent: Mar. 24, 2026

(54) LONG-LIFE ALUMINUM ALLOY WITH A HIGH CORROSION RESISTANCE AND HELICALLY GROOVED TUBE PRODUCED FROM THE ALLOY

(71) Applicant: HYDRO PRECISION TUBING (SUZHOU) CO., Ltd, Suzhou (CN)

(72) Inventors: Minxia Li, Suzhou (CN); Arvid Espedal, Mårslet (DK); Nagaraj V. Govindaraj, Tønder (DK); Ole Johannes Emmerhoff, Torvastad (NO); Guo Pingchuang, Suzhou (CN); Jinghui Su, Suzhou (CN); Hongping Xu, Suzhou (CN)

(73) Assignee: HYDRO PRECISION TUBING (SUZHOU) CO., LTD, Suzhou (CN)

( * ) Notice: Subject to any disclaimer, the term of this patent is extended or adjusted under 35 U.S.C. 154(b) by 502 days.

(21) Appl. No.: 17/626,748

(22) PCT Filed: Nov. 21, 2019

(86) PCT No.: PCT/IB2019/060038
§ 371 (c)(1),
(2) Date: Jan. 12, 2022

(87) PCT Pub. No.: WO2021/014203
PCT Pub. Date: Jan. 28, 2021

(65) Prior Publication Data

US 2022/0259704 A1 Aug. 18, 2022

(30) Foreign Application Priority Data

Jul. 22, 2019 (CN) ..... 201910661744.0

(51) Int. Cl.
*F28F 1/40* (2006.01)
*C22C 21/00* (2006.01)
(Continued)

(52) U.S. Cl.
CPC ..... *C22C 21/16* (2013.01); *C22C 21/00* (2013.01); *C22C 30/02* (2013.01); *C22C 30/06* (2013.01);
(Continued)

(58) Field of Classification Search
None
See application file for complete search history.

(56) References Cited

U.S. PATENT DOCUMENTS

| | | | |
|---|---|---|---|
| 2004/0040634 | A1 | 3/2004 | Morere et al. |
| 2006/0231170 | A1 | 10/2006 | Parson et al. |
| 2008/0050269 | A1 | 2/2008 | Tanaka et al. |

FOREIGN PATENT DOCUMENTS

| | | | |
|---|---|---|---|
| CN | 1129258 | A | 8/1996 |
| CN | 1359427 | | 7/2002 |

(Continued)

OTHER PUBLICATIONS

Office Action issued Aug. 31, 2023, in Chinese Patent Application No. 201910661744.0, with English language translation and Search Report.

(Continued)

*Primary Examiner* — Keith D. Hendricks
*Assistant Examiner* — Janell C Morillo
(74) *Attorney, Agent, or Firm* — Wenderoth, Lind & Ponack, L.L.P.

(57) ABSTRACT

An aluminium alloy including 1.0-1.5 wt % Mn, up to 0.1 wt % Mg, up to 0.3 wt % Si, up to 0.3 wt % Fe, up to 0.1 wt % Cu, up to 0.25 wt % Cr, up to 0.1 wt % Ni, up to 0.3 wt % Zn, up to 0.1% Ti, up to 0.2 Zr. The allow also includes impurities, each no more than 0.05 wt. % and wherein the total of impurities is no more than 0.15 wt. %, with the balance being aluminum.

8 Claims, 3 Drawing Sheets

(51) Int. Cl.

| | |
|---|---|
| ***C22C 21/16*** | (2006.01) |
| ***C22C 30/02*** | (2006.01) |
| ***C22C 30/06*** | (2006.01) |
| ***F28F 21/08*** | (2006.01) |
| *B21C 23/00* | (2006.01) |
| *B21C 23/10* | (2006.01) |

(52) U.S. Cl.
CPC ..... *F28F 1/40* (2013.01); *F28F 21/084* (2013.01); *B21C 23/002* (2013.01); *B21C 23/10* (2013.01)

(56) References Cited

FOREIGN PATENT DOCUMENTS

| | | | | |
|---|---|---|---|---|
| CN | 101765674 | A | | 6/2010 | |
| CN | 102506602 | A | | 6/2012 | |
| CN | 104264005 | | | 1/2015 | |
| CN | 104342586 | | | 12/2016 | |
| CN | 108531783 | | | 9/2018 | |
| CN | 109158845 | A | | 1/2019 | |
| EP | 1136581 | A1 | | 9/2001 | |
| EP | 1 892 308 | | | 2/2008 | |
| EP | 2 278 252 | | | 1/2011 | |
| JP | H01195263 | A | | 8/1989 | |
| JP | 2010-085065 | | | 4/2010 | |
| JP | 2011-007384 | | | 1/2011 | |
| JP | 2011-080121 | | | 4/2011 | |
| JP | 2012-112000 | | | 6/2012 | |
| JP | 2012112000 | A | * | 6/2012 | |
| WO | 2000/050656 | | | 8/2000 | |
| WO | 2011/152384 | | | 12/2011 | |
| WO | WO-2011152384 | A1 | * | 12/2011 | ..... F28F 1/40 |
| WO | WO-2012008463 | A1 | * | 1/2012 | ..... B21C 1/24 |
| WO | WO-2012043492 | A1 | * | 4/2012 | ..... F28F 21/08 |

OTHER PUBLICATIONS

Preliminary Notice of Reasons for Rejection issued Dec. 26, 2023, in corresponding Japanese Patent Application No. 2022-502397, with English language translation.

International Searching Authority, "International Search Report and Written Opinion" issued for corresponding International Application No. PCT/IB2019/060038, mailed on Mar. 31, 2020 (11 pages).

Extended European search report issued Jul. 12, 2023 in European Patent Application No. 19938404.1.

* cited by examiner

LONG-LIFE ALUMINUM ALLOY WITH A HIGH CORROSION RESISTANCE AND HELICALLY GROOVED TUBE PRODUCED FROM THE ALLOY

TECHNICAL FIELD

The invention relates to an aluminium alloy for use in tubes for heat exchangers and to tubes produced from the alloy. The tubes preferably have inner helical grooves or inner straight grooves or a combination of straight and helical grooves. The invention also relates to heat exchangers comprising the tubes.

BACKGROUND ART

When manufacturing heat transfer tubes for heat exchangers it is important to assure an efficient heat transfer performance of the tube. It is known to provide heat transfer tubes with alternating grooves on their inner surfaces. The grooves cooperate to enhance turbulence of fluid heat transfer mediums, such as water, delivered within the tube. This turbulence increases the fluid mixing close to the inner tube surface to reduce or virtually eliminate the boundary layer build-up of the fluid medium close to the inner surface of the tube which may otherwise increase the heat transfer resistance of the tube. The grooves and ridges also provide extra surface area for additional heat exchange.

Helically grooved tubes (hereinafter HG tube) are widely applied in heat exchangers in domestic and commercial air conditioners, heat pump water heaters etc. The process for internal grooving of heat exchanger tubes are known from e g EP1866119. The alloy used for HG tubes in the market is mainly AA3003 or AA3003 with zinc arc spray coating for better corrosion resistance. There is a demand for corrosion resistant heat exchangers and so called "long-life" alloys are used in many applications to meet the requirements. Existing long-life alloys however cannot be applied to make helically grooved tubes because of the limitation in drawability and tensile strength. AA3003 alloy HG tubes do not meet the corrosion resistance requirements in the market, while it has excellent drawability and high tensile strength, as well as good endurance to the tough helical grooving process. The corrosion resistance may be improved by spraying the tubes with a Zn coating. However, if improving AA3003 HG tube corrosion resistance by adding zinc arc spray, the cost will be increased a lot because of zinc arc spray and zinc diffusion annealing processes. Consequently, there is a need for a long-life alloy, which is suitable for making a helically grooved tube.

SUMMARY OF THE INVENTION

For the purpose of resolving the above mentioned problems, one aspect of the invention relates to an aluminium alloy preferably comprising 1.0-1.5 wt % Mn, up to 0.1 wt % Mg, up to 0.3 wt % Si: up to 0.3 wt % Fe, up to 0.1 wt % Cu, up to 0.25 wt % Cr, up to 0.1 wt % Ni, up to 0.3 wt % Zn, up to 0.1 wt % Ti, up to 0.2 wt % Zr and unavoidable impurities, each 0.05 wt. % maximum and the total of impurities 0.15 wt. % maximum, balance aluminium.

Another aspect of the invention relates to an aluminium tube produced from the alloy according to the invention.

A further aspect of the invention relates to heat exchanger comprising tubes and fins, wherein the tubes are made from the aluminium tube according to the invention.

The alloy according to the invention is suitable for making corrosion resistant tubes for heat exchangers. In particular, the alloy is suited for making helically grooved tubes due to its mechanical strength and formability in combination with its corrosion resistance properties. Heat transfer tubes are commonly used in equipment, for example, evaporators, condensers, coolers and heaters, used in the automotive and HVAC&R sector. A variety of heat transfer mediums may be used in these applications, including, but not limited to, pure water, a water glycol mixture, any type of refrigerant (such as R-22, R-134a, R-123, R410a etc.), ammonia, petrochemical fluids, and other mixtures.

DETAILED DESCRIPTION

Figure 1:
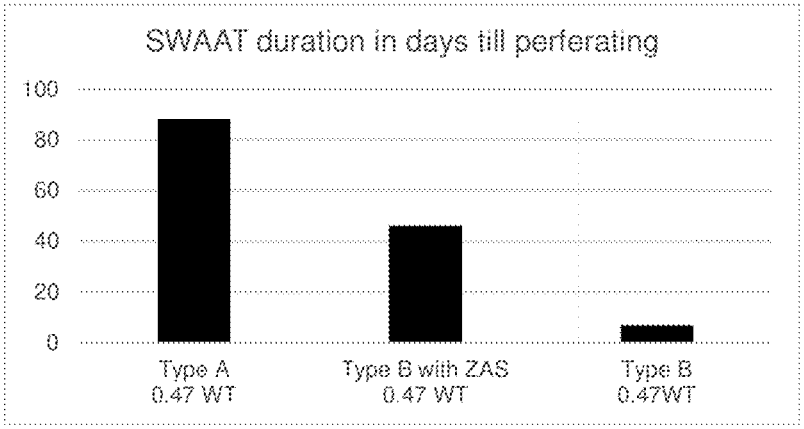
FIG. 1 shows the time to perforation of tubes of alloy A according to the invention and tubes made from alloy B with and without a Zn coating.

The alloy in Table 1 is a long-life alloy specification according to the invention for making heat exchanger tubes. The chemical composition comprises 1.0-1.5 wt % Mn, up to 0.1 wt % Mg, preferably 0.08 wt % Mg, up to 0.3 wt % Si: up to 0.3 wt % Fe, up to 0.1 wt % Cu, up to 0.25 wt % Cr, up to 0.1 wt % Ni, up to 0.3 wt % Zn, up to 0.2% Ti, up to 0.2 Zr and unavoidable impurities, each 0.05 wt. % maximum and the total of impurities 0.15 wt. % maximum, balance Aluminium.

Preferably the alloy of the invention relates to an aluminium alloy comprising 1.0-1.2 wt % Mn, up to 0.1 wt % Mg, preferably 0.08 wt % Mg, 0.10-0.15 wt % Si: up to 0.3 wt % Fe, up to 0.05 wt % Cu, up to 0.03-0.2 wt % Cr, up to 0.05 wt % Ni, up to 0.2-0.3 wt % Zn, up to 0.1 wt % Ti, up to 0.2 wt % Zr and unavoidable impurities, each 0.05 wt. % maximum and the total of impurities 0.15 wt. % maximum, balance aluminium.

Most preferably the alloy invention relates to an aluminium alloy comprising 1.0-1.1 wt % Mn, up to 0.05 wt % Mg, 0.10-0.15 wt % Si: up to 0.3 wt % Fe, up to 0.05 wt % Cu, 0.05-0.1 wt % Cr, preferable 0.0 up to 0.05 wt % Ni, 0.2-0.25 wt % Zn, up to 0.05 wt % Ti, up to 0.05 wt % Zr and unavoidable impurities, each 0.05 wt. % maximum and the total of impurities 0.15 wt. % maximum, balance aluminium.

The invention also relates to an aluminium tube produced from such aluminium alloys, in particular to tubes having an internally grooved surface. The internal grooves preferably have a height of at least 0.05 mm.

The invention also relates to a heat exchanger comprising tubes and fins, wherein the tubes are made from the inventive aluminium tubes, the heat exchanger preferably being made by inserting the tubes in holes in plates forming the fins of the heat exchanger The heat exchanger may also be a serpentine heat exchanger formed by parallel multiport extruded tubes between which undulating aluminium fins are brazed.

Zr is considered positive to corrosion due to a positive effect on the size of intermetallics and may be added up to 0.2 wt %. The formed intermetallic Al3Zr is not known to be active in a corrosive environment and thus not detrimental to the corrosion resistance. If adding more than 0.2 wt % Zr the alloy cost will be high due to Zr being an expensive element.

TABLE 1

| Elements | Si | Fe | Cu | Mn | Mg | Cr | Ni | Zn | Zr | Ti | Others Each | Others Total |
|---|---|---|---|---|---|---|---|---|---|---|---|---|
| Alloy A wt % | ≤0.3 | ≤0.3 | ≤0.1 | 1.00-1.50 | <0.1 | ≤0.25 | ≤0.1 | ≤0.3 | 0.2 | ≤0.2 | ≤0.05 | ≤0.15 |

The inventive alloy is a combination of carefully selected elements in ranges that provide properties that are particularly suitable for heat exchanger tubes with internal grooves.

Mn is the main additive element for improving the alloy strength, if the Mn amount is less than 1.0 wt %, the strength of the alloy is insufficient to undergo the helical grooving process and may cause tube breakage. If the Mn content exceeds 1.5 wt %, the tube expansion becomes difficult since the material will become too hard and more force will be needed to expand the tube which will cause the fins inside of the tube to collapse, and the tube is at risk of being bent due to high friction between the fins and the billet during expansion which will impact the tube corrosion resistance post brazing. The preferred content of Mn is 1.0-1.2 wt %, more preferably 1.0-1.1 wt %.

Alloys comprising >0.2 wt % Zr will also be more difficult to recycle and have a lower formability.

Tests have been made to compare the corrosion resistance of an alloy A, according to the invention with an alloy B with slightly higher contents of Si, Fe and Ti, but lower contents of Zn and Cr. The combined content of Zinc, Si and Fe in the alloy according to the invention is the main reason for the excellent corrosion resistance. Cr increases the strength of the alloy and compensate to some part for the lost strength due to the lower contents of Si and Fe. As can be seen in FIGS. 1 and 2, showing the SWAAT result from testing of helically grooved tubes of alloy A and B (with and without a Zn coating, "ZAS"), the corrosion resistance of Alloy A is much higher than for alloy B tubes. All non-Zn coated tubes of alloy B leak after only 7 days of exposure.

TABLE 2

| Element | Si | Fe | Cu | Mn | Mg | Cr | Ni | Zn | Ti | Other elements, each |
|---|---|---|---|---|---|---|---|---|---|---|
| Alloy A | 0.126 | 0.185 | 0.003 | 1.127 | 0.01 | 0.066 | 0.006 | 0.22 | 0.013 | — |
| Alloy B | 0.175 | 0.564 | 0.076 | 1.119 | 0.004 | 0.003 | — | 0.018 | 0.018 | — |

Mg should be ≤0.1 wt %, preferably ≤0.08 wt %, most preferably ≤0.05 wt % to get good brazing of the heat exchanger with Nocolok flux application.

Si and Fe is controlled to ≤0.3 wt % for improving the corrosion resistance. The content of Si should preferably be 0.10-0.15 wt % to improve the corrosion resistance performance.

Cr is added for refining the grain structure and improving alloy strength and corrosion resistance, but it needs to be controlled to ≤0.25 wt %, preferably ≤0.05-0.2 wt %, more preferably ≤0.05-0.1 wt % for good extrudability and good formability during the helical grooving process.

Cu shall be 0.1 wt %, preferably the Cu content shall be 0.05 wt % for good corrosion resistance of the tube.

Zn is an important element to add up to 0.3 wt % for improving pit corrosion resistance, driving corrosion uniform around tube surface. Preferably the content of Zn is 0.1 wt %-0.3 wt %, preferably 0.2-0.3 wt %, more preferably 0.25-0.3 wt %.

Fe is controlled to be up to 0.3 wt % Fe since higher contents may affect the corrosion resistance negatively. High Fe-containing particles act as cathodes dissolving anodic surroundings.

Ni is known to be very detrimental to the intergranular corrosion resistance and should be limited to ≤0.1 wt %, preferably ≤0.05 wt %.

Ti is primarily used for grain refining but is also used to improve the corrosion resistance. The Ti content should be limited to ≤0.2 wt %, ≤0.1 wt %, preferably ≤0.05 wt.

Figure 2A:
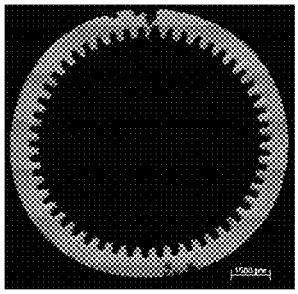
FIG. 2*a* shows a cross section of a leaking tube from a tube of alloy B after 7 days of SWAAT testing
Figure 2B:
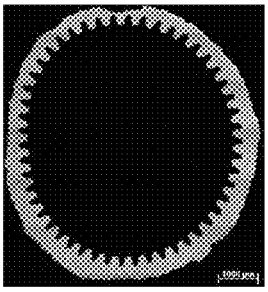
FIG. 2*b* shows a cross section of a non-perforated tube from an alloy A according to the invention after 118 days of SWAAT testing FIG. 3 Helical grooving tool box FIG. 4 Mechanical properties of an extruded tube according to the invention and a tube made from alloy B.

FIG. 2*a* is a photo of a cross section of the tube made from Alloy B which shows leakage already after 7 days of testing in SWAAT. The mode of corroding is pit corrosion while in FIG. 2*b* a cross section of a alloy A tube a more uniform corrosion has taken place and the Alloy A tubes leaked only after 118 days SWAAT.

Figure 3:
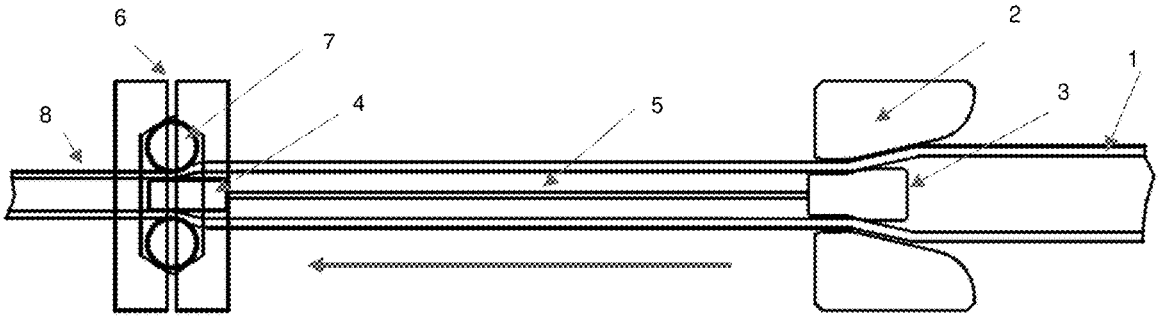

The apparatus for making a helically grooved tube is showed in FIG. 3.

Alloy billets are extruded to form a base tube (1) in an extrusion press, the base tubes are drawn by a continuous drawing machine to a size of tube (8), see FIG. 3. The tubes pass a drawing station (2) with a fixed plug (3) position, and then to fix helical grooving plug (4) position by a steel shaft (5) connection. The tubes are drawn by the helical grooving plug (4) for making helical grooves on the inside of the tube without expansion of the tube. The plug, which is put inside of the tube, shapes the tube to the required inner diameter. During helical grooving, there are steel balls (7) surrounding the tube in the gear box 6, the balls are driven by a motor that spin at high speed and presses aluminium into the die for helical grooving. The outer diameter is decided by assembly dimension of gear box size and steel ball diameter, which rotate surrounding the tube. To pass the grooving process, it is necessary that the alloy has a good formability and a high strength.

After helical grooving, the tube (1) will have a ball mark and may need to pass a sink drawing unit comprising a drawing die and a drawing plug for smoothing the outer surface and obtain the final tube size.

Figure 4:
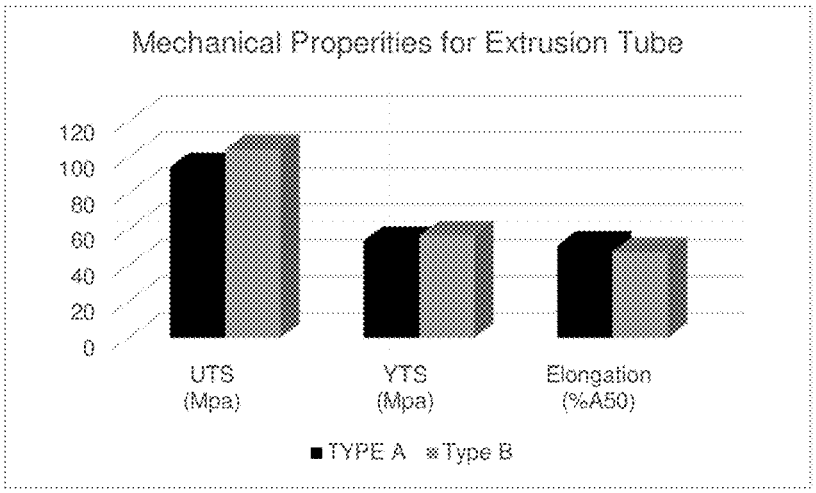

FIG. 4 shows the tensile strength of tubes tested according to EN 755-2.

The tensile strength of the HG tubes made from alloy A according to the invention is all little bit lower than for the tubes made from alloy B, but the strength is good enough to ensure a reliable manufacturing by the helical grooving process.

Figure 5:
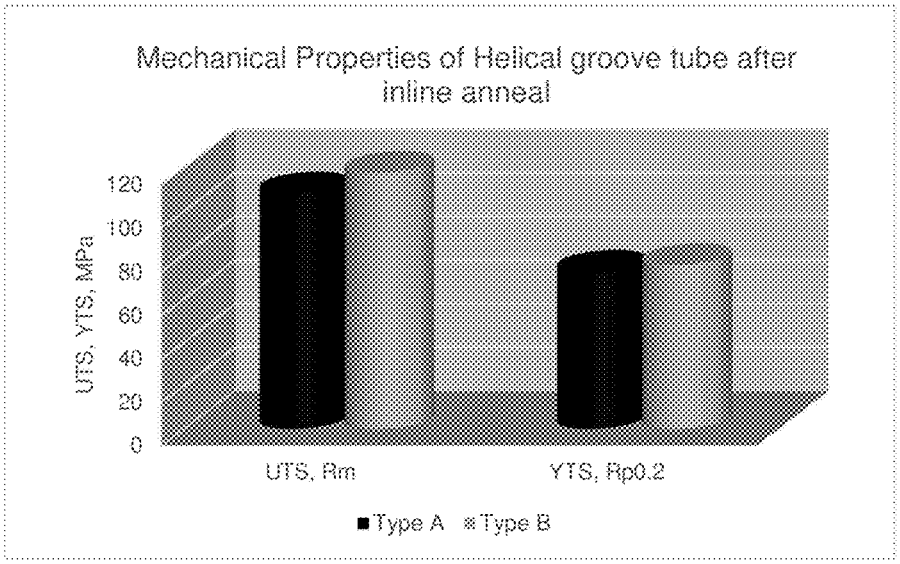
FIG. 5 Mechanical properties of a helically grooved tube according to the invention after in-line anneal compared to a tube made from alloy B.

In FIG. 5 the mechanical properties of the helical tube after inline anneal by heating tube to 450 to 550 degrees C. during drawing with 200 m/min drawing speed is shown.

Figure 6:
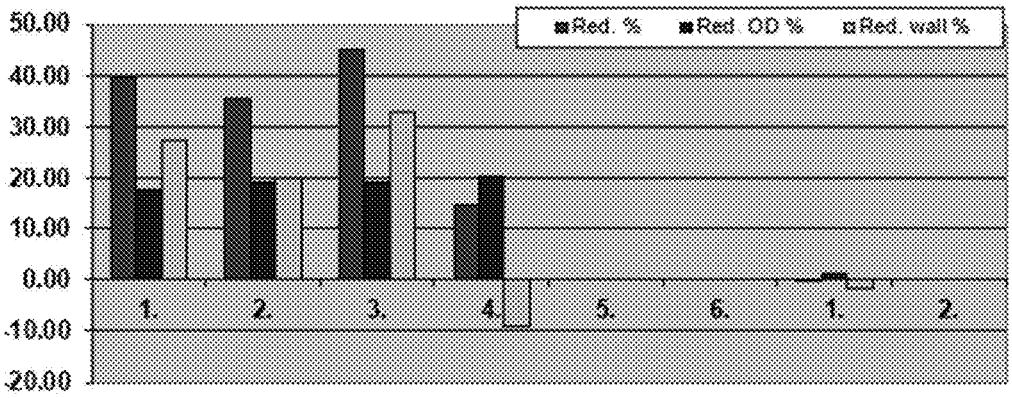
FIG. 6 Outline of the drawing process for helical grooved tube

The reduction of the tube dimensions during the drawing after different number of passes through the drawing station is shown in FIG. 6. The tube size of the tested tubes is: outer diameter (OD)=7 mm, wall thickness (WT)=0.47 mm, fin height (FH)=0.25 mm and the number of grooves (FN)=50. The drawing test is outlined in FIG. 6. The pillars in the graph shows the % reduction of the dimensions in each draw. The total drawing deformation of the tubes was 81%.

Based on the drawability of a tube made from the alloy according to the invention the outer diameter can be from 5 to 10 mm, wall thickness 0.35-0.7 mm, fin height max 0.35 mm and fin numbers max 50.

A heat exchanger with enhanced heat transfer performance is produced by forming internal grooves on the inside of tubes that are to be inserted into an insertion hole opened in an aluminum heat dissipating fin (also called fin and tube type heat exchanger) and then inserting a mandrel for expanding the tube having an outer diameter larger than the inner diameter of the heat transfer tube, and the outer peripheral surface of the heat transfer tube is in close contact with the insertion hole of the aluminum heat dissipating fin.

The alloy according to the invention can also be used to produce regular round tubes and to extrude micro-channel flat tubes (MPEs). Preferred dimensions for smooth tubes are diameters from 5-30 mm and wall thicknesses above 0.3 mm. Preferred dimensions for MPEs may be widths down to 8 mm, with minimum heights of 1 mm, and wall thicknesses above 0.15 mm.

The invention claimed is:

1. An aluminum tube having a helical inner grooved surface, produced from an aluminum alloy comprising:
- 1.0-1.5 weight percent manganese (Mn);
- up to 0.08 weight percent magnesium (Mg);
- 0.10-0.15 weight percent silicon (Si);
- up to 0.3 weight percent iron (Fe);
- up to 0.05 weight percent copper (Cu);
- 0.03-0.1 weight percent chromium (Cr);
- up to 0.1 weight percent nickel (Ni);
- 0.1-0.3 weight percent zinc (Zn);
- up to 0.1 weight percent titanium (Ti);
- up to 0.2 weight percent zirconium (Zr);
- impurities, each impurity no more than 0.05 weight percent and wherein a total of impurities is no more than 0.15 weight percent; and
- a balance of aluminum (Al).

2. The aluminum tube according to claim 1, wherein the aluminum alloy comprises:
- 1.0-1.2 weight percent Mn;
- up to 0.08 weight percent Mg;
- 0.10-0.15 weight percent Si;
- up to 0.3 weight percent Fe;
- up to 0.05 weight percent Cu;
- 0.03-0.1 weight percent Cr;
- up to 0.05 weight percent Ni;
- 9-9-0.2-0.3 weight percent Zn;
- up to 0.1 weight percent Ti;
- up to 0.2 weight percent Zr;
- impurities, each impurity no more than 0.05 weight percent and wherein the total of impurities is no more than 0.15 weight percent; and
- a balance of Al.

3. The aluminum tube according to claim 1, wherein the aluminum alloy comprises:
- 1.0-1.1 weight percent Mn;
- up to 0.05 weight percent Mg;
- 0.10-0.15 weight percent Si;
- up to 0.3 weight percent Fe;
- up to 0.05 weight percent Cu;
- 0.05-0.1 weight percent Cr;
- up to 0.05 weight percent Ni;
- 0.2-0.25 weight percent Zn;
- up to 0.05 weight percent Ti;
- up to 0.05 weight percent Zr;
- impurities, each no more than 0.05 weight percent and the total of impurities is no more than 0.15 weight percent; and
- a balance of Al.

4. The aluminum tube according to claim 1, wherein inner grooves of the inner grooved surface have a height of at least 0.05 mm.

5. A heat exchanger comprising:
- one or more tubes having a helical inner grooved surface made from an aluminum alloy comprising:
- 1.0-1.5 weight percent manganese (Mn);
- up to 0.08 weight percent magnesium (Mg);
- 0.10-0.15 weight percent silicon (Si);
- up to 0.3 weight percent iron (Fe);
- up to 0.05 weight percent copper (Cu);
- 0.03-0.1 weight percent chromium (Cr);
- up to 0.1 weight percent nickel (Ni);
- 0.1-0.3 weight percent zinc (Zn);
- up to 0.1 weight percent titanium (Ti);
- up to 0.2 weight percent zirconium (Zr);
- impurities, each impurity no more than 0.05 weight percent and wherein a total of impurities is no more than 0.15 weight percent; and
- a balance of aluminum (Al); and
- one or more fins.

6. The heat exchanger according to claim 5, wherein the one or more tubes are disposed in holes in plates forming the one or more fins of the heat exchanger.

7. The heat exchanger according to claim 5, wherein the aluminum alloy comprises:
- 1.0-1.2 weight percent Mn;
- up to 0.08 weight percent Mg;
- 0.10-0.15 weight percent Si;
- up to 0.3 weight percent Fe;
- up to 0.05 weight percent Cu;
- 0.03-0.1 weight percent Cr;
- up to 0.05 weight percent Ni;
- 0.2-0.3 weight percent Zn;
- up to 0.1 weight percent Ti;
- up to 0.2 weight percent Zr;
- impurities, each impurity no more than 0.05 weight percent and wherein the total of impurities is no more than 0.15 weight percent; and
- a balance of Al.

8. The heat exchanger according to claim 5, wherein the aluminum alloy comprises:
- 1.0-1.1 weight percent Mn;
- up to 0.05 weight percent Mg;
- 0.10-0.15 weight percent Si;

up to 0.3 weight percent Fe;
up to 0.05 weight percent Cu;
0.05-0.1 weight percent Cr;
up to 0.05 weight percent Ni;
0.2-0.25 weight percent Zn;
up to 0.05 weight percent Ti;
up to 0.05 weight percent Zr;
impurities, each no more than 0.05 weight percent and the total of impurities is no more than 0.15 weight percent; and
a balance of Al.

* * * * *